United States Patent [19]

Suzuki

[11] 4,158,979

[45] Jun. 26, 1979

[54] PAD FOR USE WITH A WOODWIND MUSICAL INSTRUMENT

[75] Inventor: Michiko Suzuki, Sendai, Japan

[73] Assignee: Michio Sugihara, Saitama, Japan

[21] Appl. No.: 837,177

[22] Filed: Sep. 28, 1977

[30] Foreign Application Priority Data

Sep. 29, 1976 [JP] Japan ..... 51-130211[U]

[51] Int. Cl.[2] ..... G10D 9/04
[52] U.S. Cl. ..... 84/385 P
[58] Field of Search ..... 84/385 P

[56] References Cited

U.S. PATENT DOCUMENTS

| | | | |
|---|---|---|---|
| 2,957,381 | 10/1960 | Hillyard | 84/385 P |
| 3,247,749 | 4/1966 | Gullotta | 84/385 P |
| 3,767,506 | 10/1973 | Kawakami | 84/385 P |
| 4,114,500 | 9/1978 | Norbeck | 84/385 P |

FOREIGN PATENT DOCUMENTS

| | | | |
|---|---|---|---|
| 1937806 | 2/1971 | Fed. Rep. of Germany | 84/385 P |

OTHER PUBLICATIONS

"Material News from Dow Corning," May–Jun. 1979.

*Primary Examiner*—Lawrence R. Franklin
*Attorney, Agent, or Firm*—Armstrong, Nikaido, Marmelstein & Kubovcik

[57] ABSTRACT

A piece of pad for use with a key cup of a woodwind musical instrument. The pad is made of either a silicone rubber only or a felt containing therein a silicone rubber, and has a flat and smooth bottom surface. The pad is fitted in the key cup with the bottom surface thereof facing a tone hole of the instrument. The silicone rubber assures desirable physical properties of the pad such as an appropriate elasticity or flexibility, and the tone hole of the instrument can be positively closed with the flat and smooth bottom surface of the pad upon pushing of the key cup by the instrument player.

2 Claims, 8 Drawing Figures

PAD FOR USE WITH A WOODWIND MUSICAL INSTRUMENT

BACKGROUND OF THE INVENTION

The present invention relates in general to an improvement on the key mechanism in use for a woodwind musical instrument, and more particularly to an improved and useful pad for use with a key cup of the woodwind musical instrument.

As is well known, in a general woodwind musical instrument construction, there are provided a plurality of finger keys around a body or tubular cylinder portion of a woodwind musical instrument. Each of the finger keys comprises a key cup of generally flat and circular shape mechanically operatively connected or linked to the tubular cylinder body of the musical instrument so as to operatively close the tone hole by the manipulation of an instrument player, and a felt pad fitted snugly into the key cup to be able to positively close the tone hole.

In such arrangement of the woodwind musical instrument, it is essential for the key cup or hence the piece of felt pad to positively close the tone hole, when manipulated or pushed by the finger of an instrument player, in such a manner that there is no air escape from between the felt pad and the circumference of the tone hole. In the conventional arrangement of the woodwind musical instrument, the felt pad is covered with a piece of fish skin over the bottom surface thereof facing the tone hole, and consequently, after a long term use or play of the woodwind musical instrument, the felt pad has inevitably a tendency to expand due to moisture in the breath or respiration of the instrument player. Therefore, when the felt pad is left as is for a long time, it would get hardened or lose its elasticity of flexibility, thus resulting in a possibly incomplete closure by thus deteriorated pad upon the tone hole. Further, the fish skin piece would get dry, turning to be hard or lose its flexibility due to dryness of the ambient air, and then the piece would be likely cracked. Such disorder in the conventional key arrangement of the instrument would lead to substantial difficulties in the performance of the musical instrument.

In addition, in the conventional construction of the woodwind musical instrument, there is a risk that an inclination of the key cup with respect to the tone hole of the instrument occurs. In order to obtain a complete closure of the tone hole with the felt pad, it was conventionally necessary for an instrument player to preliminarily take a delicate procedure of adjustment. More particularly, the player had to insert a piece of thin paper between a felt pad and a key cup so as to compensate for the inclination of the key cup in question. However, this is a very delicate job to do and hence requires a full proficiency in so doing. Moreover, due to relatively short life of the fish skin, such delicate job is inevitably the continual burden on the player at every time whe the pad covered with the deteriorated fish skin is replaced by a new one.

In view of such disadvantages inherent to the conventional felt pad, there have long been desired to provide an improved pad which has, for example, an appropriate elasticity or flexibility, property to positively close the tone hole, long service life, good water content releasability, substantial resistance against heat and coldness.

SUMMARY OF THE INVENTION

It is therefore a primary object of the present invention to provide an improved pad for use with a woodwind musical instrument which advantageously assures a positive closure of a tone hole with the pad upon pushing of a key cup by the instrument player.

It is another object of the present invention to provide an improved pad for use with a woodwind musical instrument having a long care-free service life.

It is a still other object of the present invention to provide an improved pad for use with a woodwind musical instrument having a positive moisture proof, and a substantial resistance against heat, coldness and dryness.

It is a further object of the present invention to provide an improved pad for use with a woodwind musical instrument which is easy in preparation, thus resulting in relatively low initial and maintenance costs.

It is still further object of the present invention to provide an improved pad for use with a woodwind musical instrument which is advantageously easy in handing for either installation or maintenance.

According to this invention, briefly summarized by way of a preferred embodiment thereof, there is provided an improved pad for use with a woodwind musical instrument having a plurality of key cups aligned on and around a body or tubular cylinder portion thereof, the piece of pad being positioned between the key cup and the tone hole facing the key cup, which contains a substance which is of a liquid phase and impregnated evenly throughout the piece of pad during a first step of work at an ambient temperature, the substance being able to get hardened during a second step of work after an appropriate lapse of time with a substantial extent of resiliency or flexibility.

The foregoing objects, characteristics, and details of the present invention, as well as further objects and advantages thereof, will become apparent from the following detailed description with respect to preferred embodiments of the invention when read in conjunction with the accompanying drawings, in which like parts are designated with like reference numerals.

DESCRIPTION OF THE PREFERRED EMBODIMENTS

The construction and operation of an improved pad for use with a key cup of a woodwind musical instrument according to the present invention will now be described in detail with respect to preferred embodiments thereof in conjunction with the accompanying drawings.

Figure 1:
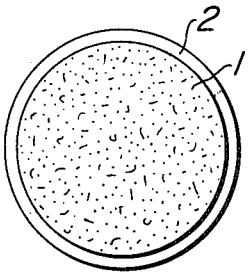
FIG. 1 shows in a front view a pad of a first embodiment of the present invention which is fitted in a key cup of a woodwind musical instrument.
Figure 4:
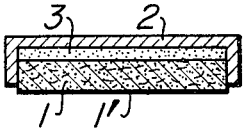
FIG. 4 is a cross-sectional view of FIG. 1 showing the pad of the first embodiment fitted in the key cup with a silicone rubber interposed therebetween.
Figure 7:
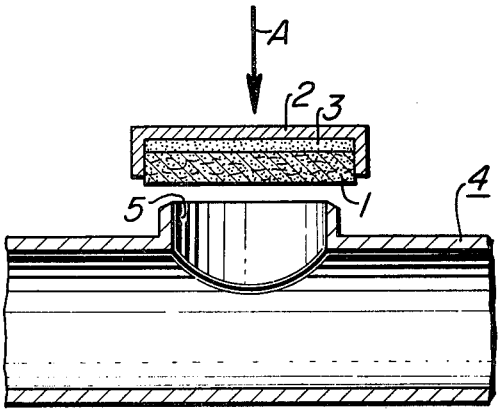
FIG. 7 shows in longitudinal sectional view of a woodwind musical instrument together with the arrangement of the key cup, pad and silicone rubber of FIG. 1 which is installed on the instrument.

Referring first to FIGS. 1 and 4, which show a first embodiment of the invention, a piece of pad 1 is of generally circular shape, and is made of a felt containing therein a silicone rubber, thereby exhibiting desirable physical properties such as an appropriate elasticity or flexibility and a good water content releasability. Further, the pad 1 has a flat and smooth bottom surface 1'. Thus, the pad 1 can positively close a tone hole of a woodwind musical instrument with the bottom surface thereof, upon manual pushing of the key cup 2 by the instrument player. The physical properties such as an appropriate elasticity of the pad as well as the flat and smooth bottom surface thereof assure the positive closure of the tone hole. In FIGS. 1 and 4, the pad 1 is fitted in the key cup 2 with a silicone rubber 3 interposed therebetween. The silicone rubber 3 achieves the functions explained hereunder with reference to, particularly, FIG. 7.

For the purpose of the invention, it is preferred to use a silicone rubber having the following advantageous physical properties:

(1) Curable or hardenable at an ambient temperature,
(2) Before hardening, having a proper fluidity and formability to any desired shapes by way of a mold,
(3) After hardening, exhibiting a minimal shrinkage or contraction of itself,
(4) After hardening, having a good resistance against heat and coldness,
(5) After hardening, having a proper elasticity and restorability, and
(6) After hardening, having a good mold-releasability, thus able to readily part from a mold after setting.

As suitable silicone rubber material for this application, having properties to meet the above-mentioned requirements, there are several typical examples of such as "Two-part RTV" (Room Temperature Vulcanizing) Rubber Series KE 111, KE 1400, KE 1600, etc., which are commercially available and marketed by Shin-Etsu Chemical Co., Ltd., Japan. By applying such a silicone rubber, the above-mentioned objects of this invention are fully attainable.

Typical examples of general physical properties of several silicone rubbers mentioned above are shown in TABLE I below.

TABLE 1

| Items | Trade Name Unit | KE 111 | KE 1400 | KE 1600 |
|---|---|---|---|---|
| Viscosity | Poise (25° C.) | 200 | 1200 | 1300 |
| Sp. Gravity | (25° C.) | 1.17 | 1.11 | 1.23 |
| Workable Time | Hour (25° C.) | ¾ | 1½ | 2 |
| Stand. Hardening Time | Hr/°C. | 8/25 | 24/25 | 24/25 |
| Hardness | JIS | 45 | 40 | 45 |
| Tensile Strength | kg/cm$^2$ | 30 | 40 | 45 |
| Stretch | % | 150 | 250 | 250 |
| Linear Contraction Coefficient | % | 0.2 | 0.5 | 0.1 |
| Use Temp. Range | °C. | −60 ~250 | −60 ~250 | −60 ~250 |
| Water Absorption Coefficient | 7 days/25° C. (%) | 0.3 | — | — |
| Thermal Conductivity | Cal. cm. sec. °C. X 10$^{-4}$ | 4.5 | — | — |
| Mechanism of Hardening | | Condensation | Condensation | Addition |

The advantages attained by assuring the positive closure of the tone hole with the pad are as follows:

(1) To provide a clearness or brightness in a tone or sound to be produced from the musical instrument; and
(2) To eliminate or prevent any difficulty in making a tone or sound by the instrument player, thus providing a good response of the musical instrument in producing a sound when played by the player.

It will be understood that, in order to assure the positive closure of the tone hole with the pad 1, it is essential that at least the portion of the bottom surface of the pad 1 which is to be contacted with the circumference edge of the tone hole when the key cup 2 is pushed or manipulated by the instrument player be flat and smooth. For providing such flat and smooth bottom surface to the pad, the use of the silicone rubber is most appropriate, since the silicone rubber has a sufficient fluidity before it is cured or hardened.

The pad of the invention can be prepared, for example, by impregnating a silicone rubber in a liquid state into a piece of a felt blank which has a thickness of about 1 to 2 mm and has a substantially larger size than an actually desirable size, and cutting the felt blank thus impregnated with the silicone rubber into the desirable shape after the silicone rubber is hardened with the lapse of a few hours. Upon preparation of the pad, it is important to have the silicone rubber impregnated evenly in the entire felt blank without leaving air bubbles therein, so as to obtain the pad having an even or a uniform elasticity as well as an even durability throughout the entire felt blank. As an effective measure to eliminate the possibility of leaving the air bubbles within the felt blank, the following step is found to be feasible, that is, after the felt blank is impregnated therein with the silicone rubber and while the silicone rubber is still in unhardened condition, an entire body of the felt blank is kept at a negative pressure of, for example, 1/10 atm. or lower for a period of about ten minutes. When the felt blank is impregnated therein with the liquid silicone rubber, it is recommendable to impregnate in the felt blank the silicone rubber in sufficient quantity. However, the quantity of the liquid silicone rubber to be impregnated in the felt blank may be suitably selected within the range that the pad having desirable physical properties as well as the flat, smooth bottom surface portion can be obtained.

As described hereinbefore, it is important that the pad has a flat and smooth bottom surface. The pad having such flat and smooth bottom surface may be obtained for example by first placing the felt blank on a glass sheet or the like having a flat and smooth surface, in turn applying the silicone rubber in a liquid state to the felt blank while maintaining the glass sheet horizontal, and in turn leaving the felt blank impregnated with the silicone rubber in the atmosphere for a few hours to thereby harden the silicone rubber. Alternatively, it is possible to impregnate in the felt blank with the liquid silicone rubber before the felt blank is placed on the glass sheet.

It is to be understood that, although the pad 1 of the first embodiment is composed of the felt containing therein the silicone rubber, the pad may be composed of silicone rubber only. The pad composed of only silicone rubber may be produced by a similar process to the process described above, however, in the manufacture of the silicone rubber pad it is indispensable to use an appropriate mold for obtaining desirable pad configuration or contour. The silicone rubber pad can bring about substantially similar advantages to those attained by the pad composed of the felt containing therein silicone rubber.

In view of the construction of the woodwind musical instrument, it is necessary to consider a given factor of inclination of the key cup of the instrument with respect to the tone hole. In order to obtain a complete closure of the tone hole with the felt pad fitted in the key cup, it was conventionally necessary for the instrument player to insert a piece of thin paper between the felt pad and the key cup so as to compensate for the inclination of the key cup with respect to the tone hole. However, this procedure is of a very delicate job to do and requires a proficiency in doing so, and moreover, since the conventional felt pad having a fish skin piece attached thereto is so delicate in handling against dryness, such delicate adjustment with the use of the thin paper has often been required.

According to the invention, the inclination of the key cup 2 with respect to the tone hole can be easily adjusted by providing the silicone rubber 3 between the pad 1 and the key cup 2. The procedure for effecting the above-mentioned adjustment to thereby achieve positive closure of the tone hole with the pad 1 is explained hereunder with reference to FIG. 7.

(1) Prepare the pad 1 which consists of either silicone rubber only or a felt containing therein silicone rubber and has a size and configuration adapted to be fitted into the key cup 2 and to be able to preferably contact with a tone hole 5 of a woodwind musical instrument 4 (The pad 1 is prepared by the previously explained process.);

(2) Fill in the key cup 2 an appropriate quantity of silicone rubber 3 in unhardened state;

(3) Dispose the pad 1 on the silicone rubber 3 filled in the key cup 2 as mentioned in item (2) above, and then apply a pressure of about 50 to 200 gr. on the key cup 2 in the direction shown by an arrow A toward the tone hole 5, and leave as is the arrangement of the key cup 2, silicone rubber 3 and the pad 1 at an ambient temperature for a few hours until the silicone rubber 2 gets hardened.

In the above procedure, an appropriate adhesive (not shown) is preliminarily applied between the key cup 2 and the silicone rubber 3, for the purpose of fixing the pad 1 to the key cup 2 through the silicone rubber 3. Alternatively, it is possible to use a fixture of the well-known type for the fixation of the pad to the key cup, the fixture being explained hereunder with reference to the second and the third embodiments.

With the above procedure, the fixation between the key cup 2 and the pad 1 can be positively achieved. Moreover, there is achieved an outstanding improvement on the closing function of the key cup 2 upon the tone hole 5 when the key cup 2 is manually pushed by the instrument player.

As will be understood from the foregoing, the pad of the present invention has improved physical properties as well as the flat and smooth bottom surface. Thus, it may be conveniently used with the key cup of the woodwind musical instrument. Further, in the case where the pad 1 is fitted in the key cup 2 with the silicone rubber 3 interposed therebetween as described hereinbefore, the closure function with the pad 1 can be further improved.

Figure 2:
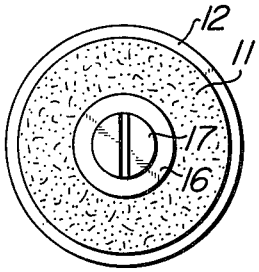
FIG. 2 is a similar view to FIG. 1 showing a second embodiment of the invention.
Figure 5:
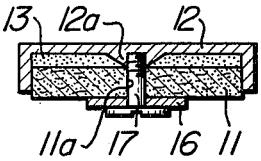
FIGS. 5 and 6 are similar views to FIG. 1 showing in cross-sectional views the pads of the second and third embodiments, respectively.

FIGS. 2 and 5 show a second embodiment of the invention. In the second embodiment, a pad 11 made of a felt containing therein a silicone rubber has a central bore 11*a*. A key cup 12 has an inward or downward projection 12*a* at the center thereof so as to define around the projection 12*a* a space for filling therein with a silicone rubber 13. The pad 11 is fixed to the key cup 12 with a fixture consisting of a small bolt 17 inserted through the central bore 11*a* and screwed into the projection 12*a* of the key cup 12. In FIGS. 2 and 5, numeral 16 designates a washer. Other structures of the pad 11 as well as the arrangement of the key cup 12, silicone rubber 13 and the pad 11 of the second embodiment are similar to those of the first embodiment, and the pad 11 and the arrangement of the second embodiment can be obtained in a substantially similar manner to those of the first embodiment.

Figure 3:
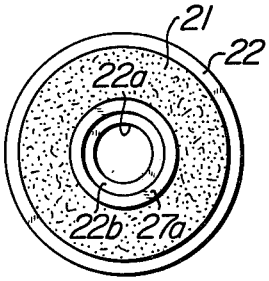
FIG. 3 is a similar view to FIG. 1 showing a third embodiment of the invention.
Figure 6:
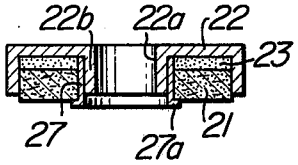

FIGS. 3 and 6 show a third embodiment of the invention. In the third embodiment, a pad 21 made of a felt containing therein a silicone rubber is of ring-like configuration. A key cup 22 is formed with a central bore 22*a*, and has an inside annular concave portion into which a silicone rubber 23 and the pad 21 are fitted. The pad 21 is fixed to the key cup 22 with a fixture consisting of an annular insert 27 fitted on an radially inner cylindrical wall 22*b* of the key cup 22 and having an outward or lower flange portion 27*a* radially outwardly bent for positively holding the pad 21. Other structures of the pad 21 as well as the arrangement of the key cup 22, silicone rubber 23 and the pad 21 of the second embodiment are substantially similar to those of the first embodiment, and the pad 21 and the arrangement of the second embodiment can be obtained in a similar manner to those of the first embodiment.

It will be understood that, although the pads 11 and 21 of the second and the third embodiments, respectively, are made of felts containing therein silicone rubbers, the respective pads 11 and 21 may be made of silicone rubbers only as in the first embodiment.

Figure 8:
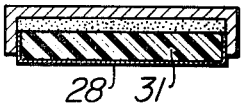
FIG. 8 is a cross-sectional view similar to FIG. 4 showing a fourth embodiment of the invention.

FIG. 8 shows a fourth embodiment of the invention. The fourth embodiment is substantially similar to the first embodiment described, except that in the fourth embodiment a fish skin 28 covers the bottom surface of a pad 31 which is made of only a silicone rubber. The pad 31 may be composed of a felt containing therein a silicone rubber as in the first embodiment. The fish skin 28 is provided in view of the delicacy in performance of the woodwind musical instrument as well as the delicacy of the instrument player. More particularly, with the provision of the fish skin 28, the instrument player may feel substantially same touch as experienced during his performance with the use of the instrument equipped with a key cup to which conventional pad having the fish skin attached thereto is mounted. It will be understood that the fish skin may be provided to cover the bottom surfaces of the pads of the second and the third embodiments, respectively.

Although detailed descriptions have been made exclusively on the foregoing typical embodiments of this invention, it should be understood that the preferred embodiments as described and shown herein do not mean in any way the limitations of this invention, but on the contrary, many changes or modifications with respect to the construction and arrangement in practice thereof may further be derived by those skilled in the art to which the present invention pertains, whereby the advantageous characteristics of this invention may be realized without departing from the spirit and scope of the invention as set forth hereunto in the appended claims.

What is claimed is:

1. A pad for use with a woodwind musical instrument, said instrument having a plurality of tone holes and a plurality of key cups, said pad having a bottom surface and being adapted to be mounted in said key cup with the bottom surface thereof facing the tone hole of said instrument, wherein the improvement comprises forming said pad of a felt impregnated with a silicone rubber while said silicone rubber is in a liquid state and then hardening said liquid silicone rubber impregnated felt by exposing the rubber impregnated felt to a silicone rubber hardening temperature for an appropriate time period, said silicone rubber providing said pad with substantial elasticity, and said bottom surface of said pad being flat and smooth at least at the portion thereof which is to contact said tone hole upon manipulation of said key cup by an instrument player.

2. A pad as defined in claim 1, wherein said pad is covered over the bottom surface thereof with a fish skin.

* * * * *